US005678437A

United States Patent [19]

Walla

[11] Patent Number: 5,678,437

[45] Date of Patent: Oct. 21, 1997

[54] LOCK FOR FURNITURE CLOSURE

[76] Inventor: Gregg Walla, 235 Hickory Ct., Lake Bluff, Ill. 60044

[21] Appl. No.: 405,845

[22] Filed: Mar. 17, 1995

[51] Int. Cl.[6] ..... E05B 9/08

[52] U.S. Cl. ..... 70/370; 70/379 R; 70/451

[58] Field of Search ..... 70/367, 370–374, 70/379 R, 379 A, 381, 451, 468

[56] References Cited

U.S. PATENT DOCUMENTS

| | | | |
|---|---|---|---|
| 629,630 | 7/1899 | Voight | 70/370 |
| 659,484 | 10/1900 | Lockwood | 70/370 |
| 1,875,209 | 8/1932 | Baldwin, Jr. | 70/370 |
| 2,948,141 | 8/1960 | Vahlstrom | 70/370 |
| 3,626,729 | 12/1971 | Kane et al. | 70/370 X |
| 3,964,280 | 6/1976 | Kelton | 70/370 X |
| 4,609,233 | 9/1986 | Walla | 70/82 X |
| 4,761,978 | 8/1988 | Walla | 70/367 |
| 4,873,850 | 10/1989 | Lyons et al. | 70/370 X |
| 4,873,852 | 10/1989 | Nemret | 70/370 X |
| 4,914,932 | 4/1990 | Walla | 70/367 |

FOREIGN PATENT DOCUMENTS

| | | | |
|---|---|---|---|
| 390669 | 10/1990 | European Pat. Off. | 70/370 |
| 8303597 | 7/1938 | France | 70/370 |
| 994868 | 11/1951 | France | 70/370 |
| 879217 | 6/1953 | Germany | 70/370 |

OTHER PUBLICATIONS

Catalog—"Locking Systems For Wood Furniture" —Timberline Supply, Ltd. (1993).

*Primary Examiner*—Suzanne Dino

*Attorney, Agent, or Firm*—Wood, Phillips, VanSanten, Clark & Mortimer

[57] ABSTRACT

A lock having a body with a central axis, an actuator, first structure cooperating between the body and actuator for mounting the actuator for movement relative to the body between first and second positions, a mounting plate defining a surface facing axially of the body to confront a wall on which the lock is mounted, second structure cooperating between the mounting plate and at least one of the body and actuator for a) maintaining the mounting plate in operative relationship with the body and b) allowing the mounting plate to be moved selectively axially relative to the body, and third structure cooperating between the mounting plate and at least one of the body and actuator for fixing the mounting plate in a plurality of different operative positions relative to the body.

25 Claims, 3 Drawing Sheets

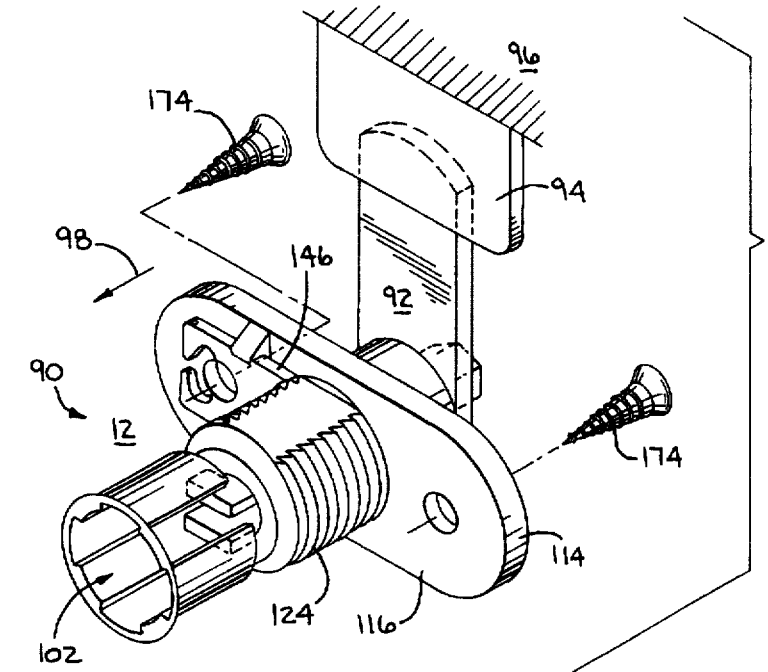
FIG. 4
FIG. 5
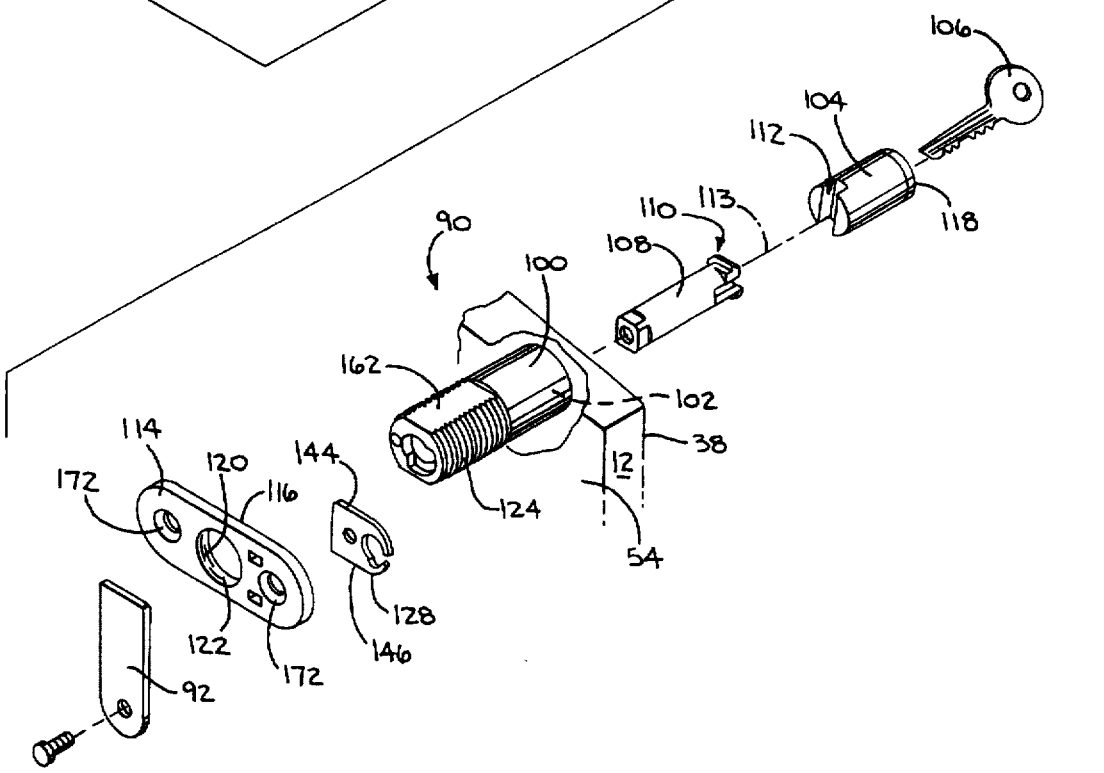

LOCK FOR FURNITURE CLOSURE

BACKGROUND OF THE INVENTION

1. Field of the Invention

This invention relates to locks of the type used to secure closures, such as doors and drawers on furniture and, more particularly, to a lock that can be assembled from one side of the closure and reconfigured to accommodate different closures having different thicknesses.

2. Background Art

It is well known to lock furniture closures using an externally accessed plug to reposition an internal locking element. The internal locking elements take a wide range of different forms, among these being a pivotable latch, a rotatable cable for operating a remote, movable latching element, etc. A cylindrical body is mounted to the closure and receives the plug which is operated through a key to effect movement of the internal locking element.

Ideally, the body, plug, and locking element define a universal assembly that is adaptable to different closure thicknesses. Heretofore, a popular construction uses a body that has a length sufficient to extend fully through the thickest anticipated closure. The body has an annular rim defining a shoulder to abut to an external surface of a closure through which the body is projected. The outer surface of the body is threaded so that with the body shoulder on the body abutted to a closure, a threaded portion of the body projects sufficiently through the closure to accept a locking nut.

To prevent rotation of the body about its lengthwise axis in use, a locking ring can be employed. The ring is keyed to the external surface of the body so that it will not rotate about the lengthwise axis of the body, yet is slidable lengthwise therealong. The ring has studs thereon that can be pressed into the inside surface of the closure. With the locking nut turned tightly on the body, the body is secured against both lengthwise and rotational movement relative to the closure.

This lock construction has a number of drawbacks. One problem is that it is often difficult or impossible to embed the studs on a surface of the closure when that surface is made from hardwoods, such as oak, or a laminate. This may result in the flattening of the studs so that only the frictional gripping forces between the flat, abutting surfaces in the body rim, the locking ring, the nut, and the closure inhibit rotation of the body.

Another problem with the above-described conventional lock is that a number of different colored escutcheons must be kept on hand to meet all customer needs. The outer rim on the escutcheon is normally carried in a number of finishes i.e. polished brass, antique brass, flat black, gloss black, etc. The exposed surface of the plug, encircled by the ring, is most commonly matched to the external rim on the body. Manufacturers of these locks are thus required to produce lock plug and bodies having different colors and finish. Suppliers must keep on hand all different finishes to meet customer demands. Installers must likewise make certain that matching body and plug combinations are on hand.

It is known to eliminate this latter problem by installing the lock from the inside of the closure element so that only a face of the lock plug is visible, and flush with, at the front of the closure. This is generally accomplished by fixedly attaching a mounting plate to the body, which can be secured, as by screws, to the inside of the closure element. To maintain the exposed plug surface flush with front closure elements having different thicknesses, it is necessary that this type of lock be offered in a variety of lengths corresponding to the most common closure thicknesses. If the plate were to be made adjustable, i.e. threadably engaged to the outer surface of the escutcheon, as would permit variation of the distance between the front surface of the plug and the plate, the plug/body combination could then freely rotate with the lock assembled to the closure. The plug, in this type of structure, could not be kept in a consistent orientation, and, in a worst case, the plug/body combination could be rotated to be threaded fully through the mounting plate to defeat the lock.

Because convenience and function are often competing objectives, as described above, heretofore, designers of furniture lock systems have generally compromised convenience and economy in order to maintain the integrity of the lock system.

SUMMARY OF THE INVENTION

The present invention is specifically directed to overcoming the above enumerated problems in a novel and simple manner.

According to the invention, a lock is provided having a body with a central axis, an actuator, first structure cooperating between the body and actuator for mounting the actuator for movement relative to the body between first and second positions, a mounting plate defining a surface facing axially of the body to confront a wall on which the lock is mounted, second structure cooperating between the mounting plate and at least one of the body and actuator for a) maintaining the mounting plate in operative relationship with the body and b) allowing the mounting plate to be moved selectively axially relative to the body, and third structure cooperating between the mounting plate and at least one of the body and actuator for fixing the mounting plate in a plurality of different operative positions relative to the body.

The lock may further include a latch element, with structure for mounting the latch element to the body for movement relative thereto between a locked position and an unlocked position and structure cooperating between the actuator and latch element for moving the latch element from its locked position into its unlocked position as an incident of the actuator moving from its first position into its second position.

The actuator may be in the form of a plug which may be key operated, with the body having a receptacle for the plug, with the first structure mounting the plug for rotation about the central axis of the body for movement between its first and second position.

In one form, the second structure includes cooperating threads in the body and mounting plate which allow the mounting plate to be moved axially relative to the body by rotation of the mounting plate relative to the body around the central axis of the body.

The third structure may include structure cooperating between the mounting plate and body for limiting relative rotation between the mounting plate and body with the mounting plate in a desired operative position on the body.

The third structure may have a) a first state wherein the mounting plate and body can be relatively rotated around the central axis of the body with the body and mounting plate in operative relationship and b) a second state wherein the third structure limits relative rotation between the mounting plate and body with the mounting plate and body in operative relationship.

In one form, the mounting plate has a bore extending therethrough to accept a fastener which can be extended into a wall on which the lock is mounted and there is structure on the third structure cooperating with the fastener extending through the mounting plate bore for causing a fastener in the mounting plate bore to block the third structure in its second state.

In one form, the third structure includes a locking tab and fourth structure cooperating between the locking tab and mounting plate for allowing the locking tab to be moved between locked and unlocked positions such that with the locking tab in the locked position, the third structure is in the second state.

The third structure may include a keying surface on the body, with the locking tab being abuttable to the keying surface with the locking tab in its locked position.

In one form, the body has a substantially cylindrical outer surface and the keying surface on the body includes a flat on the cylindrical outer surface of the body.

The third structure may include a fifth structure cooperating between the mounting plate and locking tab for normally urging the locking tab into its locked position.

This structure may include at least one bendable finger on the locking tab that is abuttable to a part of the mounting plate and deformable to allow the locking tab to be placed in its unlocked position.

The fourth structure may include structure for a) fixing the locking tab and mounting plate against relative movement axially of the body and b) allowing the locking tab and mounting plate to be relatively moved in a direction transverse to the central axis of the body.

In one form, the body has an axially spaced front and rear, with the mounting plate surface facing forwardly and the locking tab projecting forwardly beyond the mounting plate surface so that with the mounting plate urged towards a wall on which the locking plate is mounted, the locking tab is squeezed between the mounting plate and wall on which the lock is mounted to thereby secure the locking tab in one of its locked and unlocked positions.

The mounting plate may have a bore extending therethrough to accept a fastener, which fastener can be extended into a wall on which the lock is mounted. With the locking tab in its locked position, a part of the locking tab aligns with the mounting plate bore such that a fastener extended into the mounting plate bore acts against the part of the locking tab to prevent the locking tab from moving from its locked position into its unlocked position.

The invention contemplates the above structure may be provided in combination with a latch element remote from the lock that is movable between locked and unlocked positions, with there being structure cooperating between the plug and latch element for changing the latch element between its locked and unlocked positions as an incident of the plug moving from one of its first and second positions to the other of its first and second positions.

The invention further contemplates that the above structure may be provided in combination with a closure on a piece of furniture, which closure has a wall with front and rear surfaces, with there further being a bore through the closure wall, with the lock plug extending into the bore in the closure wall so that the mounting plate abuts to the rear surface of the closure and the front of the lock plug is exposed in the closure wall bore at the front of the closure wall.

The invention further contemplates a lock assembly having: a body with a central axis, a front and rear, and structure for mounting an actuator thereon; a mounting plate having a first surface; first structure cooperating between the mounting plate and body for a) maintaining the mounting plate in operative relationship with the body wherein the first surface on the mounting plate faces axially forwardly and b) allowing the mounting plate to be selectively moved axially relative to the body; and second structure cooperating between the mounting plate and body for fixing the mounting plate in a plurality of different operative positions relative to the body.

The body may have a substantially cylindrical outer surface, with the first structure including cooperating threads on the outer surface of the body and the mounting plate for effecting axial movement of the mounting plate relative to the plug as an incident of the mounting plate being rotated relative to the body.

The second structure may limit relative rotation between the body and the mounting plate.

The invention contemplates that this latter structure may be provided in combination with a closure on a piece of furniture, which closure has a wall with front and rear surfaces, with there being a bore through the closure wall, with the lock plug extending into the bore in the closure wall so that the mounting plate abuts to the rear surface of the closure and the front of the lock plug is exposed in the closure wall bore at the front of the closure wall.

BRIEF DESCRIPTION OF THE DRAWINGS

FIG. 4 is a perspective view of a part of another form of lock, according to the present invention, in a locked state relative to a catch;

FIG. 5 is an exploded, perspective view of the inventive lock in FIG. 4;

DETAILED DESCRIPTION OF THE DRAWINGS

Figure 1:
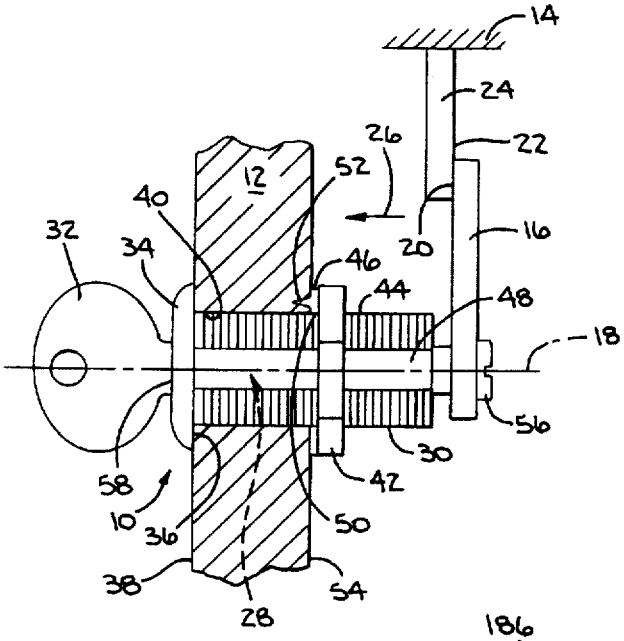
FIG. 1 (PRIOR ART)
FIG. 1 is a cross-sectional view of a closure with one type of prior art lock thereon.

In FIG. 1, one prior art lock, over which the present invention improves, is shown at 10. The lock 10 is designed to releasably maintain a movable closure element 12, as on a piece of furniture, in fixed, closed relationship to a support 14 for the closure element 12. The closure element 12 could be a pivotable door, a drawer, or the like.

The lock 10 includes a latch element 16 that is pivotable about the central axis 18 of the lock 10 between a) a locked position, as shown in FIG. 1 wherein a shoulder 20 on the latch element 16 confronts a surface 22 on a catch 24 carried by the support 14, and b) an unlocked position, wherein the latch element 16 is pivoted to allow the latch element 16 on the closure 12 to move forwardly in the direction of the arrow 26 past the catch 24, without interference therefrom, as an incident of the closure 12 being opened.

Positioning of the latch 16 is controlled by a plug 28 that is rotatable within a bore (not shown) in a cylindrical body 30. The plug 28 has a conventional construction and is operated, by rotation thereof, through a key 32 in a manner well known to those skilled in the art. The plug 28 is operatively connected to the latch element 16 so that the latch element 16 follows rotation of the plug 28 within the body 30.

The body 30 has a radially enlarged rim/flange 34 defining an annular shoulder 36 that is abuttable to a forwardly facing surface 38 on the closure 12. To assemble the lock 10, the body 30 thereon is directed through a bore 40 in the closure 12 from the front thereof until the shoulder 36 abuts to the front closure surface 38.

The plug 30 is maintained in its operative position by a nut 42, which surrounds the threaded outer surface 44 of the body 30. Tightening the nut 42 by rotation thereof, urges the nut 42, from right to left in FIG. 1. With the nut fully tightened, the closure 12 becomes firmly captively held between the shoulder 36 on the rim/flange 34 and the nut 42.

It is important that the lock 10 be consistently oriented in an operative position so the latch element 16 consistently aligns with the catch 24. To facilitate this alignment, and prevent rotation of the plug 30 within the bore 40, a locking washer 46 is provided. The washer 46 is keyed to the outer surface 44 of the body 30 in such a manner that it is movable axially therealong but cannot rotate relative thereto about the axis 18. This can be accomplished by providing one or more flats 48 on the outer surface 44 of the body 30 and making the internal washer surface 50, that surrounds the body 30, a corresponding shape.

The washer 46 has a plurality of integrally formed studs 52, which project axially forwardly. To carry out the assembly, the installer presses the plug 30 into the bore 40 from the front of the closure 12, loosely places the washer 46 and nut 42 on the threaded portion of the body 30 exposed inside the closure 12, rotates the plug 30 about the axis 18 to properly orient the plug 30, and thereafter tightens the nut 42, which plants the studs 52 in the rear surface 54 of the closure 12 so that the plug 30 is thereby fixed against rotation about the axis 18 relative to the closure 12. Once this procedure is completed, the latch element 16 can be assembled through the use of a screw 56.

This type of lock 10 has a number of drawbacks, as previously discussed. First of all, the body 30 must be assembled from the front of the closure 12, thereby requiting the separate attachment of the washer 46, nut 42, latch element 16, and screw 56 from the rear/inside of the closure 12. Installation is complicated principally by the relatively large number of parts that must be kept together and assembled on site.

Another problem is that the studs 52 cannot be pressed into a closure 12 that has a hard surface. For example, with the closure 12 made from a laminate or oak, the studs 52 could not effectively penetrate that material. The result is that the studs 52 simply fold over without penetrating the rear closure surface 54 as the nut 42 is tightened. If the closure 12 is made from a soft material, the studs 52 may strip the closure material as the plug 30 is torqued in operation.

The finish on the flange 34 is conventionally coordinated with the finish on the front surface 58 of the plug 28. Consequently, another drawback with the lock 10 in FIG. 1 is that the plug 28 and body 30 must be kept in coordinated pairs by both suppliers and installers.

Figure 2:
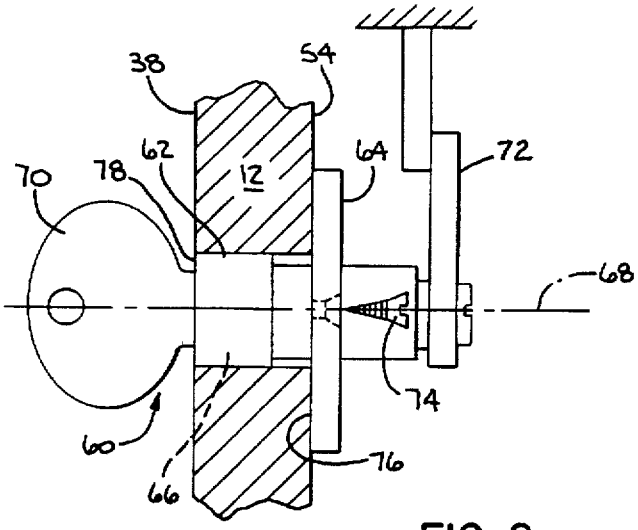
FIG. 2 (PRIOR ART)
FIG. 2 is a view as in FIG. 1 of another prior art lock that is useable in the same manner as the lock in FIG. 1.
Figure 6:
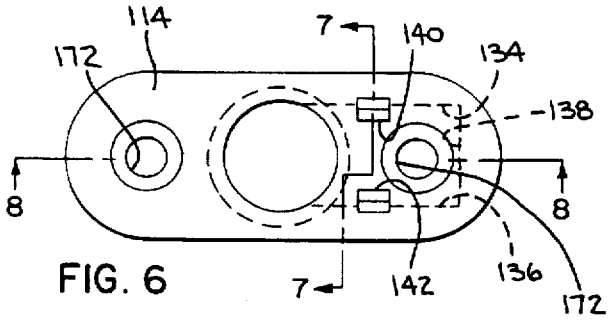
FIG. 6 is a rear elevation view of a mounting plate on the inventive lock in FIGS. 4 and 5.
Figure 7:
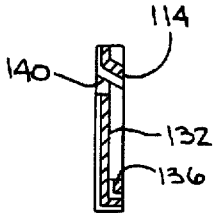
FIG. 7 is a cross-sectional view of the mounting plate taken along line 7—7 of FIG. 6.
Figure 8:
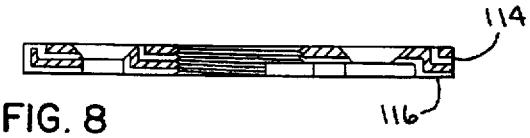
FIG. 8 is a cross-sectional view of the mounting plate taken along line 8—8 of FIG. 6.
Figure 9:
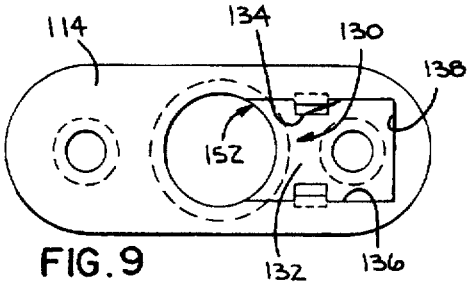
FIG. 9 is a front elevation view of the inventive mounting plate.

Another prior art lock is shown at 60 in FIG. 2. The lock 60 has a body 62 with a mounting plate 64 fixedly attached thereto. The body 62 has a similar actuating plug 66 that is rotatable about an axis 68 through a key 70 to reposition a latch element 72 between locked and unlocked positions relative to the catch 24 on the support 14 in the same manner as the latch element 16 is repositioned on the lock 10, previously described.

The lock 60 has a significant advantage over the lock 10 in that the body 62, mounting plate 64, and latch element 72 can be preassembled and installed as a unit from the inside of the closure 12. Mounting screws (one shown) 74 extend through the mounting plate 64 and into the closure 12 and upon being tightened, bear an axially forwardly facing surface 76 thereon against the inside surface 54 of the closure 12.

With the lock 60 assembled, the forward surface 78 of the plug 66 is flush with the forward surface 38 of the closure 12. With this lock configuration, each lock 60 is suitable for incorporation into only one thickness of closure 12. Consequently, both suppliers and installers of the lock 60 are required to keep on hand locks 60 having different dimensions to adapt to all anticipated thicknesses of closure 12.

In a preferred form of the invention, the advantages of the lock 60 can be realized with a universal construction that will accommodate different thicknesses of the closure 12. The inventive lock is shown in detail at 90 in FIGS. 4–14.

The lock 90 has a pivotable latch element 92 that can be selectively placed in a locked position, wherein it confronts a catch 94 on a support 96 and an unlocked position wherein the enclosure 12 with the lock 90 thereon can be moved in the direction of the arrow 98 in FIG. 4, to an open position, without interference between the latch 92 and the catch 94.

The invention contemplates incorporation of the basic concept into a virtually limitless number of different types of lock. The lock 90 shown is only intended to be exemplary of one environment in which the invention can be utilized.

The lock 90 consists of a cylindrical body 100 defining a forwardly opening receptacle 102 for a plug actuator 104, that is operable by a key 106 to selectively place the lock 90 in locked and unlocked states.

Rotative movement of the plug 104 is transmitted to the latch element 92 through an intermediate adapter 108 having a head 110 that is snap connected to a fitting 112 on the end of the key plug 104. The snap fit connection between the plug 104 and adapter 108, the connection between the adapter 108 and catch 92, and cooperating structure on the plug 104 and body 100 are peripheral to the present invention and described in detail in my U.S. Pat. Nos. 4,761,978 and 4,914,932, both of which are incorporated herein by reference. It suffices to say that rotation of the plug 104 within the body 100 about a central, fore and aft axis 113 effects corresponding rotative movement of the latch element 92 to cause the latch element 92 to selectively assume locked and unlocked states.

The focus of the present invention is on the cooperating structure on the mounting plate 114 and the body 100. The mounting plate 114 defines an axially forwardly facing surface 116 that is abuttable to the rearwardly facing surface 54 of the closure element 12 with the lock 90 in its operative position on the closure 12. With the inventive structure, the mounting plate 114 can be placed selectively in a plurality of different axially spaced, operative positions on the body 100 to thereby vary the spacing between the mounting plate surface 116 and the forwardmost plug surface 118 which fits flush to the forwardly facing surface 38 on the closure 12.

The mounting plate 116 has a through bore 120 with internal threads 122 to mate with external threads 124 on the body 100. With this arrangement, rotation of the mounting plate 114 about the central axis 113 of the lock 90 causes the mounting plate 114 to shift axially relative to the body 100 to thereby vary the spacing between the surface 116 on the mounting plate 114 and the front plug surface 118.

The invention contemplates that a tab 128 be utilized in conjunction with the mounting plate 114 to cooperate with the body 100 in such a manner as to limit rotation of the mounting plate 114 relative to the body 100 with the mounting plate 114 in the desired axial position thereon.

Figure 10:
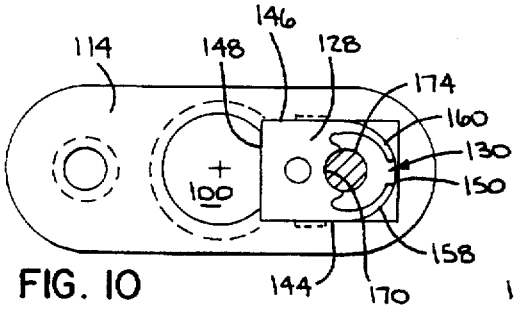
FIG. 10 is a view as in FIG. 9 with a locking tab operatively connected to the mounting plate and in a locked position.
Figure 13:
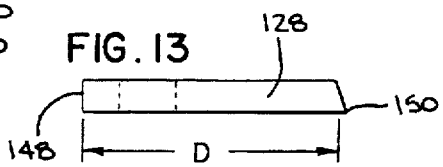
FIG. 13 is an enlarged, bottom view of the locking tab in FIGS. 10–12.
Figure 11:
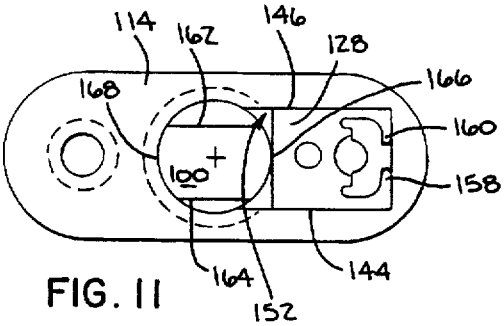
FIG. 11 is a view as in FIG. 10 with the locking tab in an unlocked position.
Figure 12:
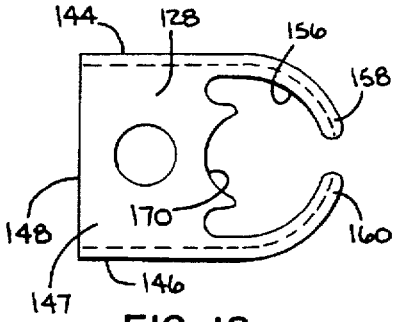
FIG. 12 is an enlarged, front elevation view of the locking tab of FIGS. 10 and 11.
Figure 14:
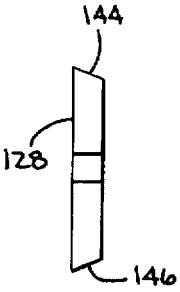
FIG. 14 is an enlarged, side elevation view of the locking tab of FIGS. 10 and 13.

The forward surface 116 on the mounting plate 114 is undercut to define a guide receptacle 130 for the tab 128 to allow the tab 128 to move guidingly within the receptacle 130 in a path at a right angle to the axis 113 between the locked position, shown at FIG. 10, and unlocked position, shown in FIG. 11.

The receptacle 130 is bounded by a forwardly facing, undercut, flat surface 132 and substantially parallel, guide edges 134, 136, which project forwardly away from the surface 132. A stop edge 138 connects between the guide edges 134, 136 and arrests translatory movement of the tab 128 within the receptacle 130 away from the central axis 113 of the mounting plate 114.

The mounting plate 114 has angled surfaces 140, 142, between the ends of the edges 134, 136, which converge from the rear to the front of the receptacle 130 to define a dovetail arrangement with similarly angled and cooperating edges 144, 146 on the tab 128.

The tab 128 has a body 147 with dimension D (FIG. 13) between radially spaced inside and outside edges 148, 150, respectively, that is less than the diameter of the through bore 120 in the mounting plate 114 to allow the outside edge 150 in alignment with an entry opening 152 on the receptacle 130 so that the tab 128 can be slid radially outwardly in the receptacle 130 into the operative position shown in FIGS. 4, 10 and 11.

The tab body 147 has a cut-out 156 that defines curved, deflectable fingers 158, 160 which are abuttable to the stop edge 138 with the tab 128 advanced from left to right in FIGS. 10 and 11. With the fingers 158, 160 in their undeformed state shown in FIG. 10, the edge 148 projects into radially overlapping relationship with the mounting plate bore 120. The body 100 has diametrically oppositely located flats/keying surfaces 162, 164, which each accommodate the tab 128 in this position. That is, the tab edge 148 abuts to one of the flats 162, 164 along substantially the entire circumferential extent thereof with the mounting plate 114 and body 100 in each of two different relative angular positions, one of which is shown in FIG. 10 and the other with the body rotated through 180° around the axis 113.

By rotating the mounting plate 114 relative to the plug 100 through approximately 90° from either of the two locked positions, the unflatted, peripheral outer edge 166, or the diametrically opposite edge 168, is borne against the tab edge 148. Since the edges 166, 168 have an effectively larger diameter than the keying surfaces 162, 164, the tab 128 is urged radially outwardly, thereby compressing the fingers 158, 160 as shown in FIG. 11.

With this arrangement, the mounting plate 114 can be rotated relative to the body 100 to axially reposition the mounting plate 114 on to the body 100. As rotation occurs, the tab 128 shifts alternatingly radially inwardly and outwardly as it encounters the flats 162, 164 and edges 166, 168 in succession. The user can tactilely sense the two locked positions with the tab edge 148 abutting to one or the other of the flats 162, 164. According to the invention, this locked position can be maintained with the mounting plate 114 in a desired axial position relative to the body 100.

The cut out 156 is configured so that a curved edge 170 defined thereby is defined by an arc with a radius equal to that of bores 172 defined through the mounting plate 114 to accommodate mounting screws 174. The bores 172 and tab 128 are relatively situated so that screws 174 directed forwardly through the bores 172 into the closure 12 abut to the tab 128 with the tab 128 in the locked position of FIG. 10. The fastener 174 thereby prevents the tab 128 from moving from the FIG. 10 position to the FIG. 11 position. With the tab 128 thus locked, the edge 148 acts against one of the keying surfaces 162, 164 to prevent relative rotation between the mounting plate 114 and body 100.

With this arrangement, the user can rotate the mounting plate 114 on the body to select the distance between the mounting plate surface 116 and the front surface 118 of the plug 104. By then directing the mounting screws 174 into the bores 172 and the cut out 156, the tab is locked in the FIG. 10 position and keyed against rotation relative to the plug 100.

Figure 3:
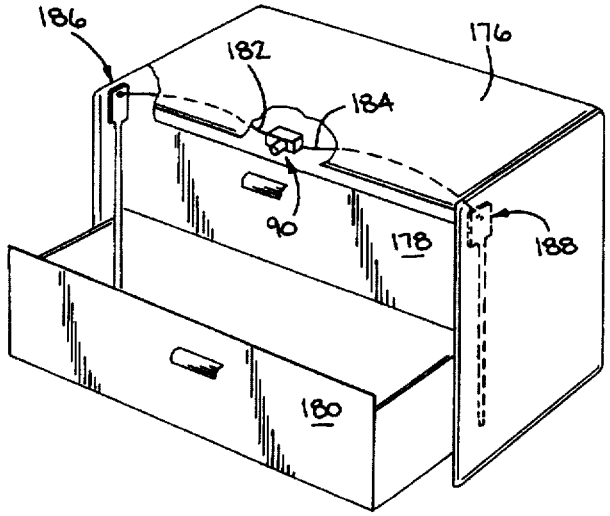
FIG. 3 is a perspective view of a piece of furniture with slidable drawers and one form of lock for the drawers, according to the present invention, incorporated therein.

As previously noted, the lock 90 is not restricted to the particular construction shown in FIGS. 4–14. In FIG. 3, an alternative arrangement is shown wherein the lock 90 is used on a file cabinet at 176 to lock a pair of drawers 178, 180 in a closed position. The lock 90 is utilized to rotate a pair of cables 182, 184 which operate remote lock modules 186, 188 of the type described in detail in my U.S. Pat. No. 4,609,233, which is also incorporated herein by reference.

The foregoing disclosure of specific embodiments is intended to be illustrative of the broad concepts comprehended by the invention.

I claim:

1. A lock comprising:

a body having a central axis;

an actuator mounted on the body for movement relative to the body between first and second positions;

a mounting plate on at least one of the body and actuator in an operative position for movement axially relative to the body, the mounting plate defining a surface facing axially of the body to confront a wall on which the lock is mounted; and a deformable locking tab acting between the mounting plate and at least one of the body and actuator for selectively fixing the mounting plate in a plurality of different operative positions spaced axially relative to the body, the locking tab being movable relative to the mounting plate between locked and unlocked positions and deforming as it is moved between the locked position and the unlocked position.

2. The lock according to claim 1 wherein the locking tab and mounting plate are placeable selectively in a) a first state wherein the mounting plate can be moved axially relative to the body and b) a second state wherein the mounting plate and locking tab limit axial movement of the mounting plate relative to the body.

3. The lock according to claim 2 wherein with the locking tab and mounting plate in the first state the locking tab is movable from the locked position into the unlocked position as an incident of the mounting plate moving axially relative to the body.

4. The lock according to claim 1 wherein the locking tab is guided in movement relative to the mounting plate between the locked and unlocked positions.

5. The lock according to claim 4 wherein the locking tab moves in translation substantially transversely to the central axis of the body between the locked and unlocked positions.

6. The lock according to claim 1 including a latch element mounted to the body for movement relative thereto between a locked position, and an unlocked position, the latch element moving from the locked position for the latch element into the unlocked position for the latch element as an incident of the actuator moving from the first position into the second position.

7. The lock according to claim 1 wherein the actuator comprises a plug, the body has a receptacle for the plug and the plug is mounted for rotation about the central axis of the body between the first and second positions.

8. The lock according to claim 1 wherein there are cooperating threads on the body and mounting plate which allow the mounting plate to be moved axially relative to the body by rotation of the mounting plate relative to the body around the central axis of the body.

9. The lock according to claim 8 wherein the locking tab limits relative rotation between the mounting plate and body with the mounting plate in a desired operative position on the body and the locking tab in the locked position.

10. The lock according to claim 9 wherein the locking tab and mounting plate have a) a first state wherein the mounting plate and body can be relatively rotated around the central axis of the body with the body and mounting plate in operative relationship and b) a second state wherein the locking tab limits relative rotation between the mounting plate and body with the mounting plate and body in operative relationship.

11. The lock according to claim 10 wherein the mounting plate has a bore extending therethrough to accept a fastener which can be extended into a wall on which the lock is mounted and a fastener is extended through the mounting plate bore and blocks the locking tab and mounting plate in the second state.

12. The lock according to claim 10 wherein the locking tab is movable between the locked and unlocked positions for the mounting tab with the locking tab and mounting plate in the first state, and with the locking tab and mounting plate in the second state the locking tab is fixed in the locked position for the locking tab.

13. The lock according to claim 12 wherein there is a keying surface on the body and the locking tab is abuttable to the keying surface with the locking tab in the locked position for the locking tab.

14. The lock according to claim 12 wherein the locking tab is normally biased into the locked position for the locking tab.

15. The lock according to claim 14 wherein there is at least one bendable finger on the locking tab that is abuttable to a part of the mounting plate and deformable to allow the locking tab to be placed in the unlocked position for the locking tab.

16. The lock according to claim 12 wherein the locking tab and mounting plate are fixed against relative movement axially of the body and the locking tab and mounting plate are relatively movable in a direction transverse to the central axis of the body.

17. The lock according to claim 12 wherein the body has an axially spaced front and rear, the mounting plate surface faces forwardly and the locking tab projects forwardly beyond the mounting plate surface so that with the mounting plate urged towards a wall on which the lock is mounted, the locking tab is captive between the mounting plate and a wall on which the lock is mounted to thereby secure the locking tab in one of the locked and unlocked positions for the locking tab.

18. The lock according to claim 12 wherein the mounting plate has a bore extending therethrough to accept a fastener which can be extended into a wall on which the lock is mounted, with the locking tab in the locked position for the locking tab, a part of the locking tab aligns adjacent to the mounting plate bore so that a fastener extended into the mounting plate bore acts against the part of the locking tab to prevent the locking tab from moving from the locked position for the locking tab.

19. The lock according to claim 13 wherein the body has a substantially cylindrical outer surface and the keying surface on the body comprises a flat on the cylindrical outer surface of the body.

20. The lock according to claim 7 in combination with a latch element remote from the lock that is movable between locked and unlocked positions and the latch element is changed between the locked and unlocked positions for the latch element as an incident of the plug moving from one of the first and second positions for the plug into the other of the first and second positions for the plug.

21. The lock according to claim 6 wherein the lock has an axially spaced front and rear and in combination with a closure on a piece of furniture, said closure having a wall with front and rear surfaces, there being a bore through the closure wall and the lock extends into the bore in the closure wall so that the mounting plate abuts to the rear surface of the closure and the front of the lock plug is exposed in the closure wall bore at the front of the closure wall.

22. The lock according to claim 1 wherein the actuator comprises a key-operated actuator.

23. The lock according to claim 1 wherein the body has a substantially cylindrical outer surface and there are cooperating threads on the outer surface of the body and the mounting plate for effecting axial movement of the mounting plate relative to the plug as an incident of the mounting plate being rotated relative to the body.

24. The lock according to claim 1 wherein axial movement of the mounting plate relative to the body causes the locking tab to engage at least one of the body and actuator and be shifted by at least one of the body and actuator between the locked and unlocked positions.

25. The lock according to claim 1 wherein the locking tab has a deflectable finger that acts against and is deformed by the mounting plate as the locking tab is moved from the locked position into the unlocked position.

* * * * *